US011002244B2

(12) United States Patent
Nafz

(10) Patent No.: US 11,002,244 B2
(45) Date of Patent: May 11, 2021

(54) HYDROSTATIC AXIAL PISTON MACHINE

(71) Applicant: Robert Bosch GmbH, Stuttgart (DE)

(72) Inventor: Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 183 days.

(21) Appl. No.: 16/377,518

(22) Filed: Apr. 8, 2019

(65) Prior Publication Data

US 2019/0316572 A1 Oct. 17, 2019

(30) Foreign Application Priority Data

Apr. 11, 2018 (DE) ..... 10 2018 205 446.0

(51) Int. Cl.

| | |
|---|---|
| ***F03C 1/28*** | (2006.01) |
| ***F04B 1/126*** | (2020.01) |
| ***F04B 1/2078*** | (2020.01) |
| ***F04B 1/2035*** | (2020.01) |
| ***F04B 1/2007*** | (2020.01) |

(Continued)

(52) U.S. Cl.

CPC ..... *F03C 1/0605* (2013.01); *F03C 1/0644* (2013.01); *F03C 1/0671* (2013.01); *F03C 1/0686* (2013.01); *F04B 1/126* (2013.01); *F04B 1/2007* (2013.01); *F04B 1/2035* (2013.01); *F04B 1/2078* (2013.01);

(Continued)

(58) Field of Classification Search

CPC ..... F04B 1/2007; F04B 1/2085; F04B 1/126; F04B 1/324; F04B 1/2078; F04B 1/2035; F04B 1/128; F04B 1/20; F04B 1/24; F03C 1/0686; F03C 1/0644; F03C 1/0671

See application file for complete search history.

(56) References Cited

U.S. PATENT DOCUMENTS

| | | | |
|---|---|---|---|
| 3,292,553 | A | 12/1966 | Hann |
| 3,295,457 | A | 1/1967 | Oram |

(Continued)

FOREIGN PATENT DOCUMENTS

| | | | |
|---|---|---|---|
| DE | 3413059 | C1 * | 7/1985 |
| DE | 4022858 | A1 * | 1/1991 |

(Continued)

OTHER PUBLICATIONS

German Search Report corresponding to German File No. 10 2018 205 446.0; dated Nov. 29, 2018; 9 Pages.

*Primary Examiner* — Charles G Freay

(74) *Attorney, Agent, or Firm* — Maginot, Moore & Beck LLP

(57) ABSTRACT

A hydrostatic axial piston machine includes a housing, a connection plate closing the housing, working connections formed on the connection plate, a drive shaft, a swashplate, a cylinder drum coupled to the shaft in the direction of rotation, bores formed in the drum and each including a piston, a control plate against which the drum bears, a retraction plate for removing a piston from the bores, and a retraction ball arranged in front of the first end face of the drum which surrounds a drum neck of the drum and the shaft and by which the retraction plate is loaded in the direction of the swashplate. A pressure chamber is defined by seals between the retraction ball, the drum, and the shaft, and is configured to be acted upon by a pressure above a housing pressure. The retraction ball is sealed against the drum neck and against the shaft.

13 Claims, 5 Drawing Sheets

(51) Int. Cl.

| | |
|---|---|
| ***F03C 1/06*** | (2006.01) |
| ***F04B 1/324*** | (2020.01) |
| ***F04B 1/2085*** | (2020.01) |
| ***F03C 1/40*** | (2006.01) |
| *F04B 1/128* | (2020.01) |
| *F04B 1/20* | (2020.01) |

(52) U.S. Cl.
CPC ..... *F04B 1/2085* (2013.01); *F04B 1/324* (2013.01); *F04B 1/128* (2013.01); *F04B 1/20* (2013.01)

(56) References Cited

U.S. PATENT DOCUMENTS

| | | | | | |
|---|---|---|---|---|---|
| 3,779,137 | A * | 12/1973 | Koivunen | F04B 1/2007 | 91/489 |
| 3,810,715 | A * | 5/1974 | Week | F04B 1/324 | 417/213 |
| 6,425,314 | B1 * | 7/2002 | Kleinedler | F04B 1/126 | 92/71 |
| 2017/0145991 | A1 * | 5/2017 | Rath | F04B 1/14 | |

FOREIGN PATENT DOCUMENTS

| | | | |
|---|---|---|---|
| DE | 10 2013 208 454 | A1 | 11/2014 |
| DE | 10 2014223564 | A * | 5/2016 |
| DE | 10 2015 223 037 | A1 | 5/2017 |

* cited by examiner

HYDROSTATIC AXIAL PISTON MACHINE

This application claims priority under 35 U.S.C. § 119 to patent application no. DE 10 2018 205 446.0, filed on Apr. 11, 2018 in Germany, the disclosure of which is incorporated herein by reference in its entirety.

BACKGROUND

The disclosure relates to a swashplate-type hydrostatic axial piston machine, in particular a hydrostatic axial piston pump. The hydrostatic axial piston machine has a housing, a connection plate closing the housing, on which connection plate the working connections are formed, a drive shaft which is rotatably mounted in the housing and in the connection plate, a swashplate, a cylinder drum which is coupled to the drive shaft in the direction of rotation and in which cylinder bores are formed in each of which a displacement piston is movable back and forth which projects on a first end face of the cylinder drum from said cylinder drum and rests against the swashplate, and a control plate against which the cylinder drum bears with its second end face, in respect of which the cylinder bores are open and via which the cylinder bores can be connected or are connected fluidically to the working connections. The control plate is a separate distributor plate which is arranged in a non-rotatable manner in respect of the connection plate. Moreover, the hydrostatic axial piston machine comprises a retraction plate for removing the displacement piston from the cylinder bores on the one half of a rotation and a retraction ball arranged in front of the first end face of the cylinder drum which is usually supported on the cylinder drum in a spring-mounted manner and which surrounds a neck of the cylinder drum and the drive shaft and by which the retraction plate is loaded in the direction of the swashplate.

A hydrostatic axial piston machine of this kind is known from DE 10 2013 208 454 A1, for example. With an axial piston machine of this kind, the cylinder drum is pushed by the pressure in the cylinder bores in the direction of the control plate, as the passages from the cylinder bores to the one end face of the cylinder drum have a smaller cross section than the cylinder bores. By means of relief fields which are exposed to pressure and adjusted in terms of their size to the loading force with which the cylinder drum is exposed to pressures in the cylinder bores in the direction of the control plate in such a manner that the relief force is smaller than the loading force, only a differential force need be mechanically transmitted at the contact faces between the cylinder drum and the control plate. In the case of customary swashplate-type axial piston machines, the control plate has two control grooves, each of which extends in arcuate fashion over an angle smaller than 180° and one of which is exposed to high pressure and the other to low pressure. With a customary axial piston machine of this kind, not only the loading force exerted by the pressures in the cylinder bores on the cylinder drum but also the relief force therefore acts eccentrically.

Depending on use, brief drive mechanism lift-ups can occur with a hydrostatic axial piston machine of this kind. This is the terminology used among experts to describe a process in which the cylinder drum lifts up from the control plate. This means that a large quantity of pressure medium is suddenly forced into the inside of the drum between the cylinder drum and the drive shaft, so that the pressure rises sharply there. The toothing between the drive shaft and the cylinder drum represents a throttle point, so that the raised pressure acts on a corresponding surface of the cylinder drum in the lifting direction of the cylinder drum. The drive mechanism lift-up is thereby reinforced and may lead to destruction of the drive mechanism.

A hydrostatic axial piston machine which is configured as a vibration drive for a high-frequency oscillating drive of a synchronous cylinder or a plurality of synchronous cylinders is already known from DE 10 2015 223 037 A1. In the case of this axial piston machine, a rotary feed-through between the cylinder drum and the connection plate comprises a number of grooves arranged concentrically to one another and running around 360° corresponding to the number of cylinder bores and pistons, each of which grooves is connected to a cylinder bore and to a working connection. The grooves may be located in a control plate which is at rest relative to the connection plate on the side thereof facing the cylinder drum. However, the grooves may also co-rotate with the cylinder drum. Since in the case of a hydrostatic axial piston machine of this kind, a high-pressure kidney extending over less than 180° is not exposed to high pressure, but depending on the momentary direction of movement of the piston, a circumferential groove running around 360° is exposed to high pressure or to low pressure, the relief force acts centrically on the cylinder drum. The load force, on the other hand, acts eccentrically because high pressure prevails only in a cylinder bore in which the free space is reduced by pistons moving and extending on the one half of the swashplate. This produces a tipping moment, so that there is a great risk that the cylinder drum will lift off the control plate on one side. This kind of lifting leads to extremely high leakage and the efficiency losses associated with this.

SUMMARY

The problem addressed by the disclosure is that of developing a hydrostatic axial piston machine with a housing, with a connection plate on which working connections are formed which closes the housing, with a drive shaft which is pivotably mounted in the housing and in the connection plate, with a swashplate, with a cylinder drum which is coupled to the drive shaft in the direction of rotation and in which cylinder bores are formed in each of which a displacement piston is movable back and forth, said displacement piston projecting from the cylinder drum on a first end face thereof and resting on the swashplate, with a control plate on which the cylinder drum bears with its second end face, towards which the cylinder bores are open and via which the cylinder bores are fluidically connectable or connected to the working connections, with a retraction plate for removing the displacement pistons from the cylinder bores on one half of a rotation and with a retraction ball arranged in front of the first end face of the cylinder drum which surrounds a neck of the cylinder drum and the drive shaft and through which the retraction plate is loaded in the direction of the swashplate, in such a manner that the risk of the cylinder drum lifting from the control plate is small and a high degree of efficiency is achieved.

This problem is solved for a hydrostatic axial piston machine which has the features described above, in that the retraction ball is sealed against the neck of the cylinder drum and against the drive shaft and that the retraction ball pressure chamber created by the seals between the retraction ball, the cylinder drum and the drive shaft can be acted upon by a pressure above the housing pressure.

While in the case of the hydrostatic axial piston machines known in the art, on account of the large clearance between the retraction ball and the cylinder drum and between the retraction ball and the drive shaft, the critical throttle point for pressure build-up in the drum interior between the cylinder drum and the drive shaft is the toothing between the cylinder drum and the drive shaft, due to the seal according to the disclosure between the retraction ball and the cylinder drum, on the one hand, and between the retraction ball and the drive shaft, on the other hand, when there is a pressure build-up in the drum interior the retraction ball pressure chamber between the cylinder drum, the retraction ball and the drive shaft is also exposed to an at least approximately identical pressure as the drum interior. This pressure produces a force on one face of the cylinder drum directed in such a manner that this force acts on the cylinder drum in the direction of the control plate, in other words as an additional load force. The lifting tendency of the cylinder drum is thereby reduced. The effectiveness of the axial piston machine is improved. It is particularly advantageous in this case for the load force to engage centrically with the cylinder drum and therefore, in the case of a hydrostatic axial piston machine for an oscillating drive of a synchronous cylinder or a plurality of synchronous cylinders according to DE 10 2015 223 037 A1, to engage in alignment with the relief force on the cylinder drum.

It is particularly advantageous for the sealing diameter of the seal between the neck of the cylinder drum and the retraction ball to be greater than the diameter of a sealing surface lying towards the drive shaft between the cylinder drum and the control plate. This means that the loading force is greater than the relief force in the space between the cylinder drum and the drive shaft and also in the retraction ball pressure chamber inside the retraction ball.

An external pressure connection may be provided to which the pressure chamber is connected via a fluid path. The external pressure connection is advantageously located on the connection plate, wherein the fluid path leads from the external pressure connection through the connection plate into the retraction ball pressure chamber. If the aforementioned relationship applies between the sealing diameters, the fluid path may lead via the drum interior to the retraction ball pressure chamber. The drum interior is then also exposed to pressure. Due to the relationship indicated above between the sealing diameters, a generated load force is greater than a generated relief force, however. Due to the greater load force available, the grooves and relief webs on the control plate can also be enlarged, so that losses are reduced there. Moreover, these geometries may be more pressure-resistant in design.

An external pressure connection is particularly advantageous in the case of a vibration drive, as has been described in greater detail above. With a vibration drive of this kind, a working connection during the extension of a piston is a high-pressure connection and during the retraction of a piston it is a low-pressure connection.

By contrast, in the case of a hydrostatic axial piston machine with a defined high-pressure side and a defined low-pressure side, the retraction ball pressure chamber may be connected to the high-pressure side via a fluid path. If the high-pressure side and the low-pressure side change depending on the direction of rotation or the position of a swashplate that can be pivoted via a zero position, a tapping of the high pressure with a two-way valve could take place. It is also conceivable for a two-way valve of this kind to be arranged between two grooves in a vibration drive of the aforementioned kind.

If the drum interior and the retraction ball pressure chamber are not acted upon by pressure from an external pressure source or a high-pressure side of the axial piston machine, but in the event of an imminent drive mechanism lift-up pressure builds up in the drum interior due to the inflow of pressure medium from the high-pressure-conducting grooves or channels, which produces an additional relief force, this pressure also acts in the retraction ball pressure chamber and produces a relief force on the cylinder drum there which counteracts lifting. In this way, the drive mechanism is protected from destruction.

It is conceivable for the seal between the retraction ball and the drum neck or the seal between the retraction ball and the drive shaft to be configured as a split seal through a correspondingly narrow sizing of the parts. The seal advantageously comprises a sealing ring between the retraction ball and the neck of the cylinder drum, which sealing ring is inserted into an annular groove formed on the neck of the cylinder drum and bears against the retraction ball.

The seal between the retraction ball and the drive shaft advantageously comprises a sealing ring which is inserted into an annular groove formed on the drive shaft and bears against the retraction ball.

An annular groove with a sealing ring inserted may also be located in the retraction ball, however, if the drive shaft or the neck of the cylinder drum is weakened excessively by an annular groove of this kind or this arrangement is regarded as advantageous for some other reason.

In the case of the hydrostatic axial piston machines commonly used today, it is customary for the drive shaft to be rotatably mounted in the housing and on the other side of the control plate, viewed from the cylinder drum, via a bearing in the control plate. In an advantageous embodiment of a hydrostatic axial piston machine according to the disclosure, the bearing of the drive shaft in the connection plate is configured as a sealing point, so that the drive shaft is not exposed to pressure on its end face projecting into the connection plate. A fluid path can be provided via which leakage oil flowing into the space in front of the end face of the drive shaft is diverted into the housing interior, for example.

The bearing may be configured as a slide bearing in the form of a bearing bush which acts as a split seal. In order for it to act as a seal, it is advantageous for the sliding surfaces of the pair of sliding surfaces to be smoothly configured between the bearing bush and the drive shaft without any interruption. This means that the bearing bush has no groove, such as an axial groove or a spiral groove, for example.

The disclosure can be used particularly advantageously in the case of a hydrostatic axial piston machine which is configured as a vibration drive and exhibits a plurality of grooves arranged concentrically to one another running around 360° in a rotary feed-through between the cylinder drum and the control plate, each of which is permanently fluidically connected to a cylinder bore and to a working connection. In the case of a hydrostatic axial piston machine of this kind which has already been referred to above, there is an offset between the engagement points of the load force and the relief force, so that the probability of a drive mechanism lift-up is particularly great.

BRIEF DESCRIPTION OF THE DRAWINGS

Two exemplary embodiments of a hydrostatic axial piston machine according to the disclosure are depicted in the drawings, wherein only the drive mechanism of the second exemplary embodiment is shown. The disclosure is explained in greater detail with the help of the drawings.

In the drawings

DETAILED DESCRIPTION

Figure 1:
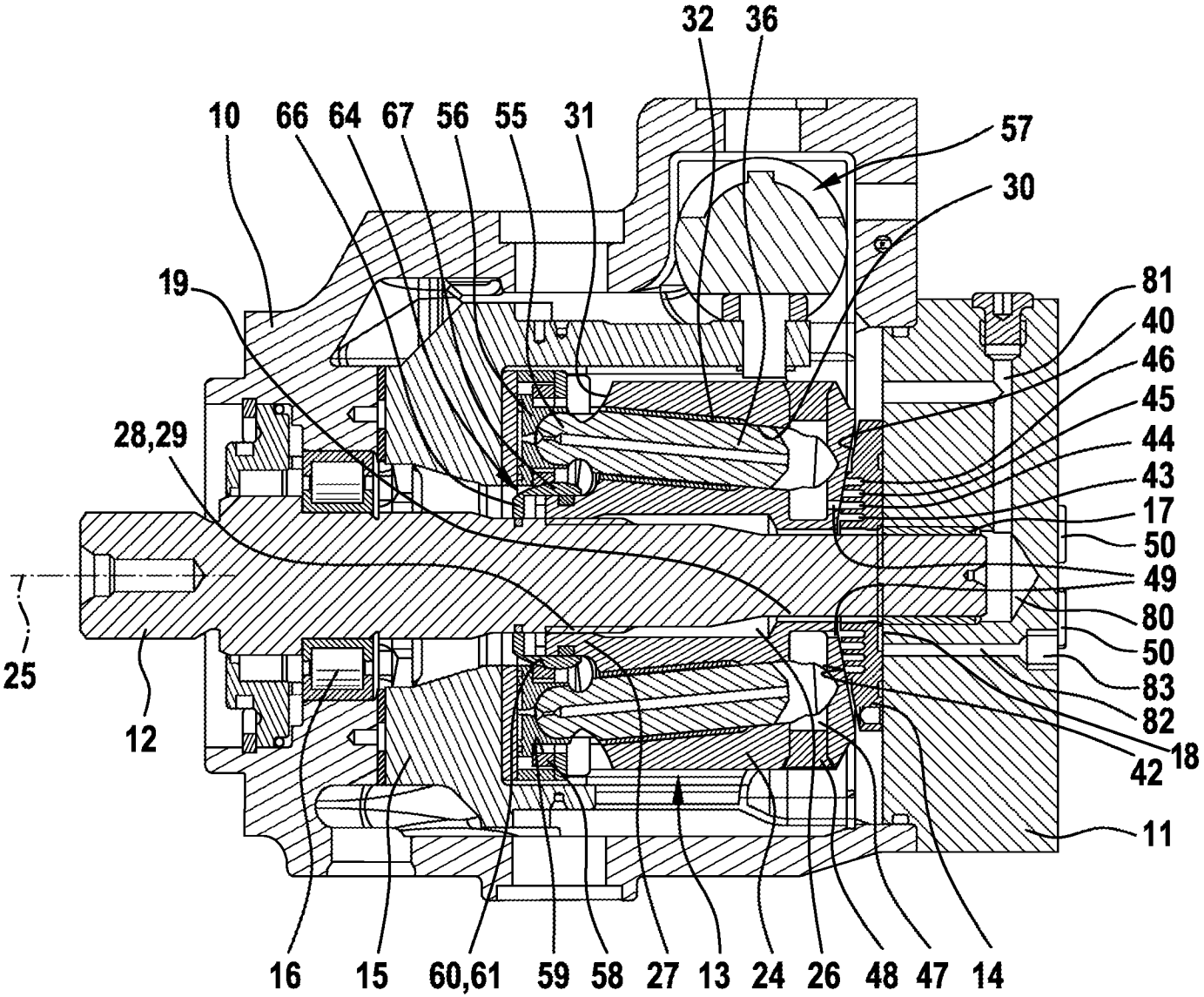
FIG. 1 shows a longitudinal section through the first exemplary embodiment which is a hydrostatic piston machine adjustable in terms of its stroke volume which is configured as a vibration drive.
Figure 2:
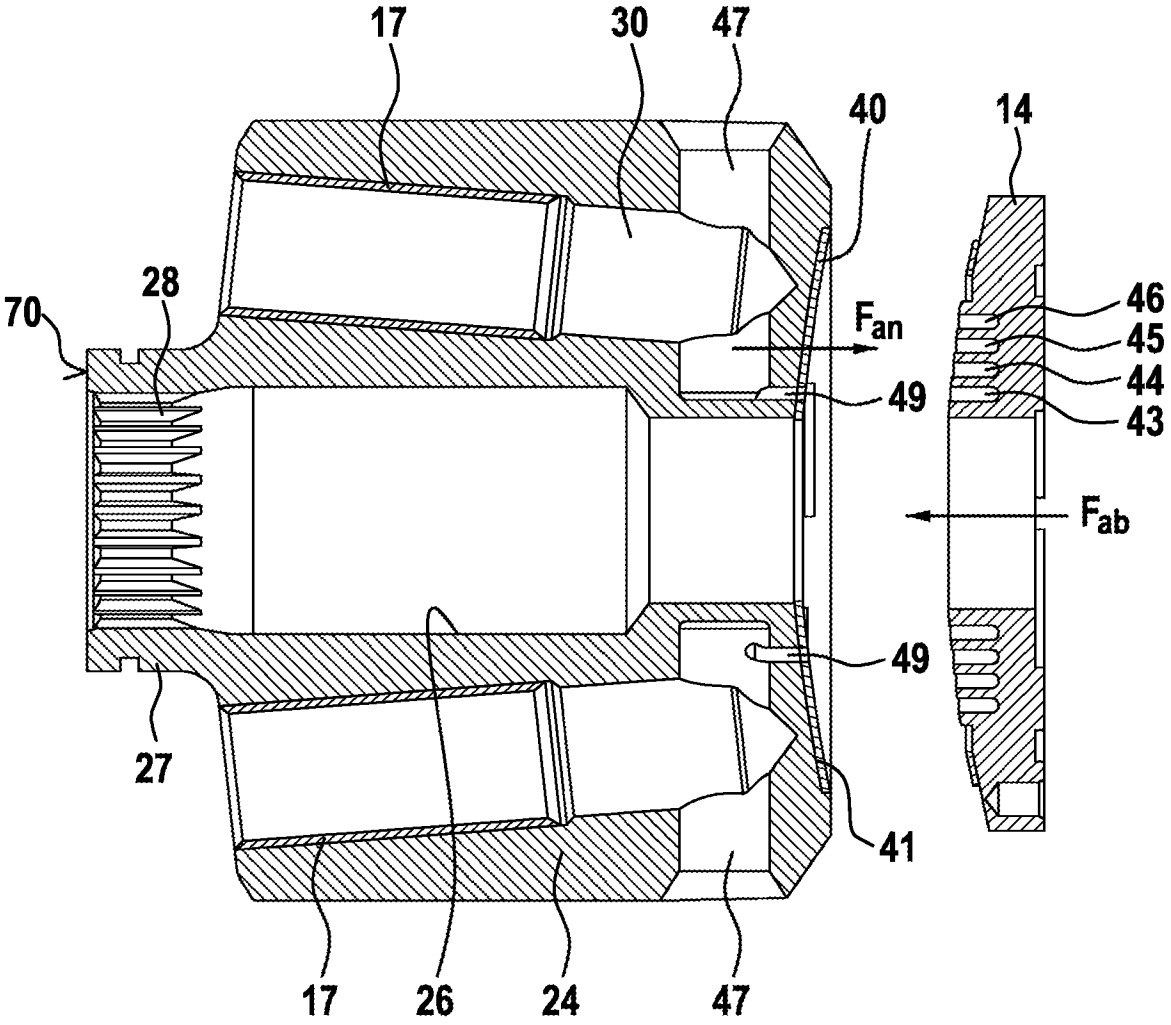
FIG. 2 shows an enlarged and exploded representation of the cylinder drum and the control plate from FIG. 1.

The hydrostatic axial piston machine according to FIGS. 1 and 2 is provided to drive two synchronous cylinders in a high-frequency, oscillating manner. It is therefore referred to below as a vibration drive. The vibration drive has a swashplate-type design and is adjustable in terms of its stroke volume. The volume flow which is conveyed to a synchronous cylinder is proportionate to the drive speed and the stroke volume which is determined by the oblique position of the pivotable swashplate.

The vibration drive comprises a pot-like housing 10, a connection plate 11 closing the open end of the housing 10, a drive shaft 12, a cylinder drum 13, a control plate 14 configured as a control plate separate from the connection plate 11 which is arranged between the cylinder drum 13 and the connection plate 11 and is fixed relative to the connection plate, and the already mentioned swashplate 15 which is adjustable in terms of its inclination relative to the axis of the drive shaft 12 and which is also referred to as a pivot cradle on account of its pivotability. The pivot cradle 15 in this case can be pivoted from a position in which it is virtually perpendicular to the axis of the drive shaft 12 in a direction to a maximum pivot angle.

The drive shaft 12 is rotatably mounted in the bottom of the housing 10 via a rolling contact bearing 16 and in the connection plate 11 via a slide bearing, namely a bearing bush 17.

The cylinder drum 13 has a substantially circular-cylindrical main body 24 with a center axis 25. The main body 24 has a continuous central cavity 26 in the direction of the central axis in which the drive shaft 12 crosses through the cylinder drum 13. In the region of a drum neck 27 projecting towards the pivot cradle 15 with a smaller outer diameter, the main body is formed with an internal toothing 28 which engages with corresponding toothing 29 on the drive shaft 12. The cylinder drum 13 is connected to the drive shaft 12 in a non-rotatable but axially movable manner via the toothing and is therefore able to bear against the control plate 14 without clearance.

Four cylinder bores 30 lying on the same pitch circle which are uniformly distributed over the circumference are introduced into the main body 24, said cylinder bores being placed slightly obliquely in respect of the center axis 25 in the exemplary embodiment which coincides with the center axis of the drive shaft 12 and being open radially outside the drum neck 27 on an outer end face 31 of the cylinder drum 13 facing the pivot cradle 15. The diameter of the cylinder bores 30 is slightly larger in a front portion starting on the outer end face 31 and extending over roughly 60 percent of the total length of a cylinder bore than in a rear portion. The two portions of a cylinder bore 30 merge with one another in a radial step.

A bushing 32 is inserted in the portion of each cylinder bore 30 exhibiting the greater diameter, which bushing lies with its outer end face roughly aligned with the opening of the cylinder bore 30 on the outer end face 31 of the cylinder drum 13. The fit outer diameter D of the bushing 32 and the internal diameter of the cylinder bore 30 are adapted to one another in such a manner that a press fit is created between the bushing and the cylinder drum. A displacement piston 36 is guided in an axially movable manner in each bushing 32. The inner diameter of a bushing 32 is slightly smaller than the diameter of the rear portion of a cylinder bore 30, so that a clear ring gap between a displacement piston 36 and the wall of a cylinder bore 30 is created in this rear portion.

The cylinder drum 13 has a spherically concavely curved inner end face 41 provided with a sliding layer 40, with which end face it bears against a correspondingly convexly curved control surface 42 of the control plate 14. In the control surface 42 of the control plate 14 are located four control grooves 43, 44, 45 and 46 which are limited in terms of their depth and run around 360° concentrically to the center axis 25 of the cylinder drum and therefore also concentrically to the center axis of the control plate 14, which control grooves, when the cylinder drum rests against the control surface 42 with its end face 41, are sealed in respect of one another. Precisely one of the four cylinder bores 30 in each case is fluidically connected to precisely one of the four control grooves 43, 44, 45 and 46. In order to make the connection between a cylinder bore 30 and a control groove, a radial bore 47 configured as a blind hole is introduced into the main body 24 of the cylinder drum 13 at a small distance from the inner end face 41, which radial bore intersects the cylinder bores and is outwardly closed by a closing screw 48. An axial bore 49 starting from the end face 41 of the cylinder drum 13 opens into each radial bore 47, wherein the distances of the four axial bores 49 in total differ from the center axis 24 in such a manner that a first radial bore 49 is open on the end face 41 to the control groove 43, a second radial bore 49 on the end face 41 to the control groove 44, a third radial bore 49 on the end face 41 to the control groove 45 and a fourth radial bore 49 on the end face 41 to the control groove 46. Each control groove 43, 44, 45 and 46 is likewise fluidically connected to one of four working connections 50 formed on the connection plate via a bore in the control plate 14 not depicted in greater detail and a channel in the connection plate 11 likewise not depicted.

The displacement pistons 36 have a spherical head 55 at their end facing the pivot cradle 15 which projects into a corresponding recess in a sliding shoe 56, so that a ball joint is formed between the displacement piston and the sliding shoe. The displacement pistons 36 are supported on the pivot cradle 15 by means of the sliding shoes 56, so that said displacement pistons 36 perform a lifting movement during operation in the bushings and in the cylinder bores 30. The size of the stroke in this case is determined by the inclination of the pivotable pivot cradle 15. An actuating device 57 is provided in order to adjust the inclination of the pivot cradle 15.

So that the displacement pumps 36 do not lift off the pivot cradle 15, but also remain on the pivot cradle during the so-called suction stroke, a retraction plate 58 is provided which bears against a shoulder formed on each sliding shoe 56 and has a break-through 59 for each sliding shoe, through which the sliding shoe passes to enclose the spherical head 55 of a displacement piston 36. The break-through is of such a size that the sliding shoes have the necessary freedom of movement in a plane parallel to the bearing surface on the pivot cradle 15. The retraction plate 58 has a central opening 60 which has a conical or spherical edge 61 and such a small diameter that a there is a large clearance between the retraction plate and the drive shaft 12. Consequently, there is space for a retraction ball 64 which is configured in the manner of a ball layer and therefore has a ball zone 65 as an outer surface with which it is pressed against the edge 61 of the retraction plate 58. The retraction ball 64 has a central graduated axial break-through, so that a kind of inner collar 66 on it which closely surrounds the drive shaft 12 and an axially longer bush-like portion 67 which surrounds the drum neck 27 can be distinguished from one another. The inner collar 66 has an axial spacing from the drum neck 27, so that between the drum neck 27, the drive shaft 12 and the retraction ball 64 there is an annular free space 68.

A stack of plate springs 69 which is clamped axially between the retraction ball 64 and an axial annular surface 70 of the drum neck 27 is located in said free space and presses the retraction ball 64 against the retraction plate 58, the retraction plate against the sliding shoes 56 and the sliding shoes against the pivot cradle 15.

During operation, when a displacement piston 36 is extended into a cylinder bore 30 via a radial bore 47, an axial bore 49 and one of the control grooves in the control plate 14 is displaced to a working connection 50 on the connection plate 11 and further into a cylinder chamber of a synchronous cylinder, while pressure medium flows from the other cylinder chamber of the synchronous cylinder into a cylinder bore 30 with a retracting displacement cylinder 36. In the fluid path in which pressure medium is displaced from a cylinder bore 30 to a working connection 50 of the vibration drive, pressure builds up which is also present in the corresponding circular control groove of the control plate 14. In this way, an axial force $F_{ab}$ acts between the cylinder drum 13 and the control plate 14, the engagement point whereof lies on the center axis 25. The pressure which has built up is also present in the cylinder bore 30 and produces a pressing axial force $F_{an}$ on a surface which is equal to the cross section of a displacement piston 36 less the cross section of the axial bore 49, which axial force presses the cylinder drum 13 against the control plate 14. The engagement point of the pressing force $F_{an}$ is spaced apart from the center axis 25. The forces $F_{ab}$ and $F_{an}$ and also their engagement points are entered in FIG. 2. If pressure medium is displaced from a plurality of cylinder bores 30, as is the case with the vibration drive shown with four cylinder bores and four displacement cylinders, the individual pressing forces add up to a total force $F_{an}$, the engagement point whereof is furthermore spaced apart from the center axis 25.

Due to the different engagement point of the force $F_{ab}$ and the force $F_{an}$, a tipping moment occurs on the cylinder drum 13 which tries to lift the cylinder drum 13 on one side from the control plate. In order to prevent this, according to the disclosure the cylinder drum 13 is pressed against the control plate with a force which acts in the center axis 25.

Figure 4:
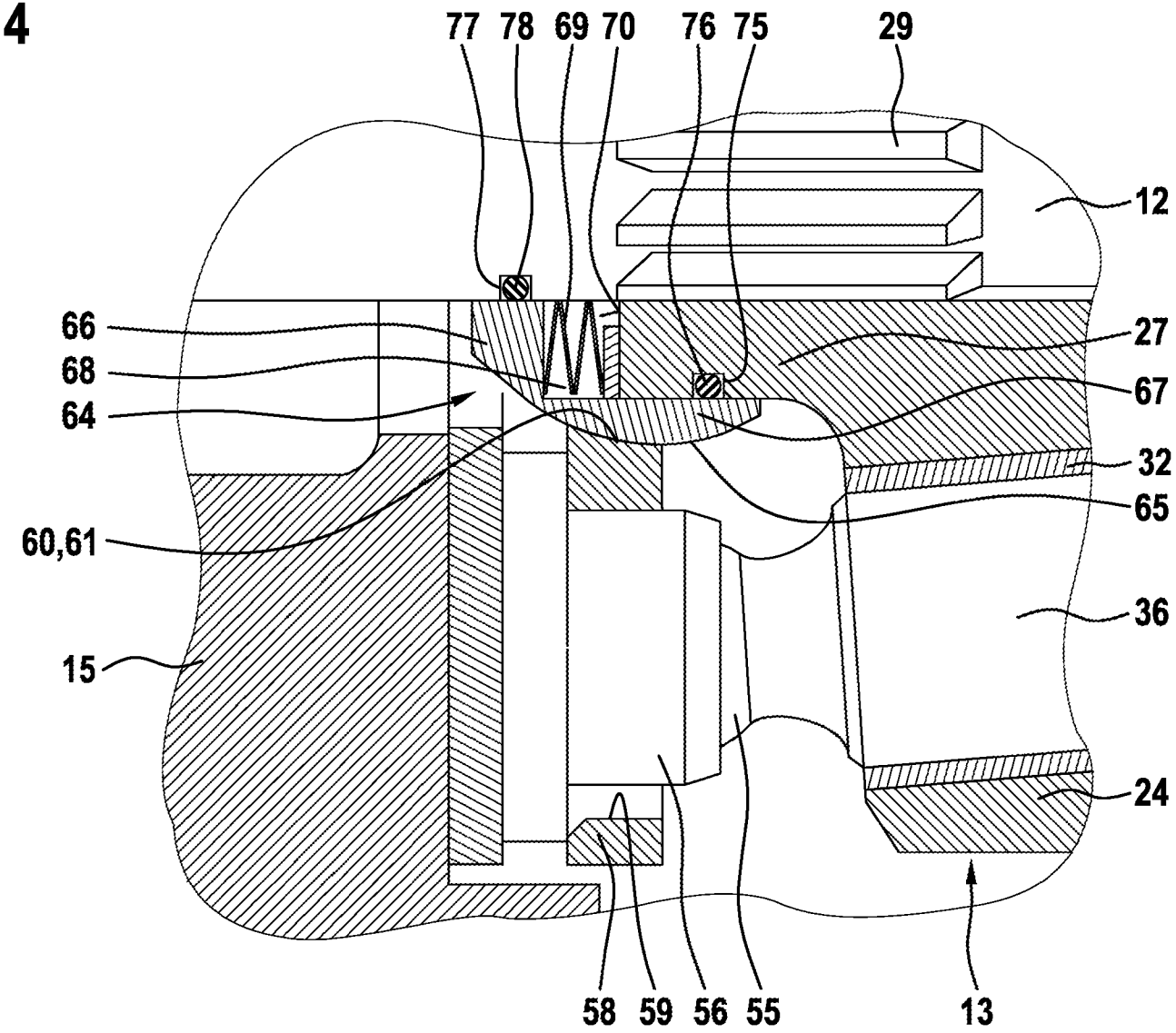
FIG. 4 shows a partial region of FIG. 1 or FIG. 2 in a larger scale and in a longitudinal section turned through 90°.
Figure 5:
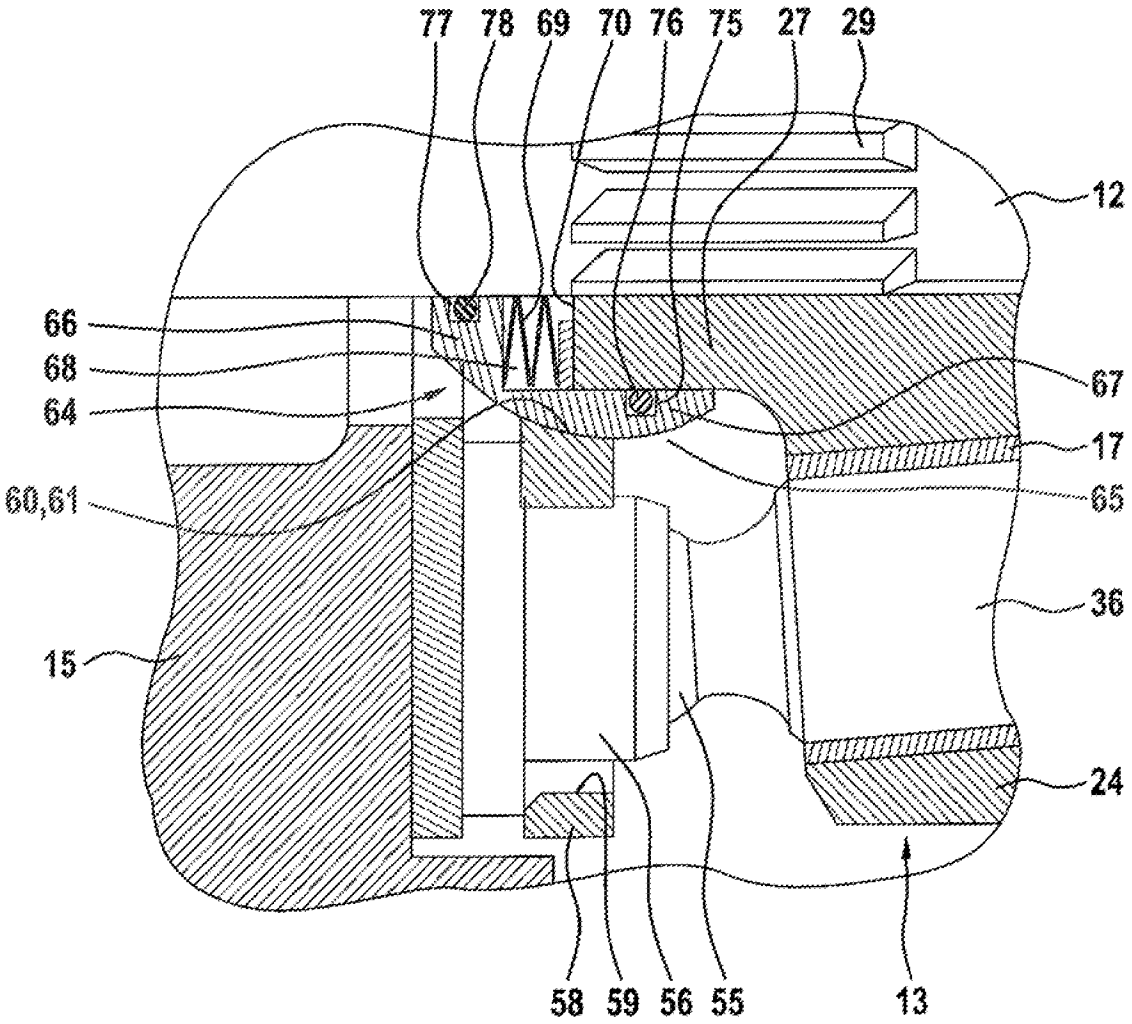
FIG. 5 shows the same partial region as in FIG. 4 in a variant of the two exemplary embodiments.

For this purpose, the annular free space 68 between the drum neck 27, the drive shaft 12 and the retraction ball 64 is initially sealed in respect of the housing interior. As emerges particularly clearly from the enlarged depiction according to FIG. 4, the drum neck 27 has an annular groove 75 on the outside in which a sealing ring 76 is inserted which rests radially against the portion 67 of the retraction ball 64. An annular groove 77 is also introduced into the drive shaft 12 in which a sealing ring 78 adjacent to the inner collar 66 of the retraction ball 64 is inserted. Alternatively, as shown in FIG. 5, the annular grooves 75 and 77 may also be located in the retraction ball 64. Consequently, the free space 68 at the gaps between the retraction ball 65 and the drive shaft 12 and also the drum neck 27 is sealed against the housing interior and may be referred to as a pressure chamber, in particular as a retraction ball pressure chamber. The pressure in said pressure chamber may be higher than the housing pressure prevailing outside the cylinder drum and the retraction ball.

The clearance between the toothing 28 and 29 of cylinder drum 13 and drive shaft 12 is so great that the retraction ball pressure chamber 68 and the central hollow space 26 of the cylinder drum can be regarded as a pressure chamber. For further sealing of this pressure chamber, the bearing bush 17 is configured in such a manner that it acts as a gap seal. The space 80 in front of the end face of the drive shaft 12 projected into the connection plate 11 is relieved of pressure via a fluid path to the housing interior which is configured as a bore 81. The pressure chamber created by the seals between the retraction ball, the drive shaft 12 and the cylinder drum 13, on the one hand, and by the split seal via the bearing bush 17, on the other hand, can be exposed to a contact pressure from an external pressure source via a bore 82 in the connection plate 11 and also via an axial path 18 running axially between the control plate 14 and the connection plate and a radial path 19 running radially between the control plate 14 and the drive shaft 12. For this purpose, the bore 82 goes from an external pressure connection 83 to the connection plate 11. The contact pressure produces an additional force acting on the cylinder drum 13 in the center axis 25. This force presses the cylinder drum 13 against the control plate 14, since the outer diameter of the drum neck 27 is greater than the diameter within which the contact pressure acts on the inner end face 41 of the cylinder drum 13.

The pressure chamber created by the different seals is advantageous even without the connection to an external pressure source. If the cylinder drum 13 is briefly lifted from the control plate 14, a very large amount of pressure medium is suddenly forced into the pressure chamber. This means that the pressure rises sharply there. This pressure produces a pressing force which counteracts the lifting.

Figure 3:
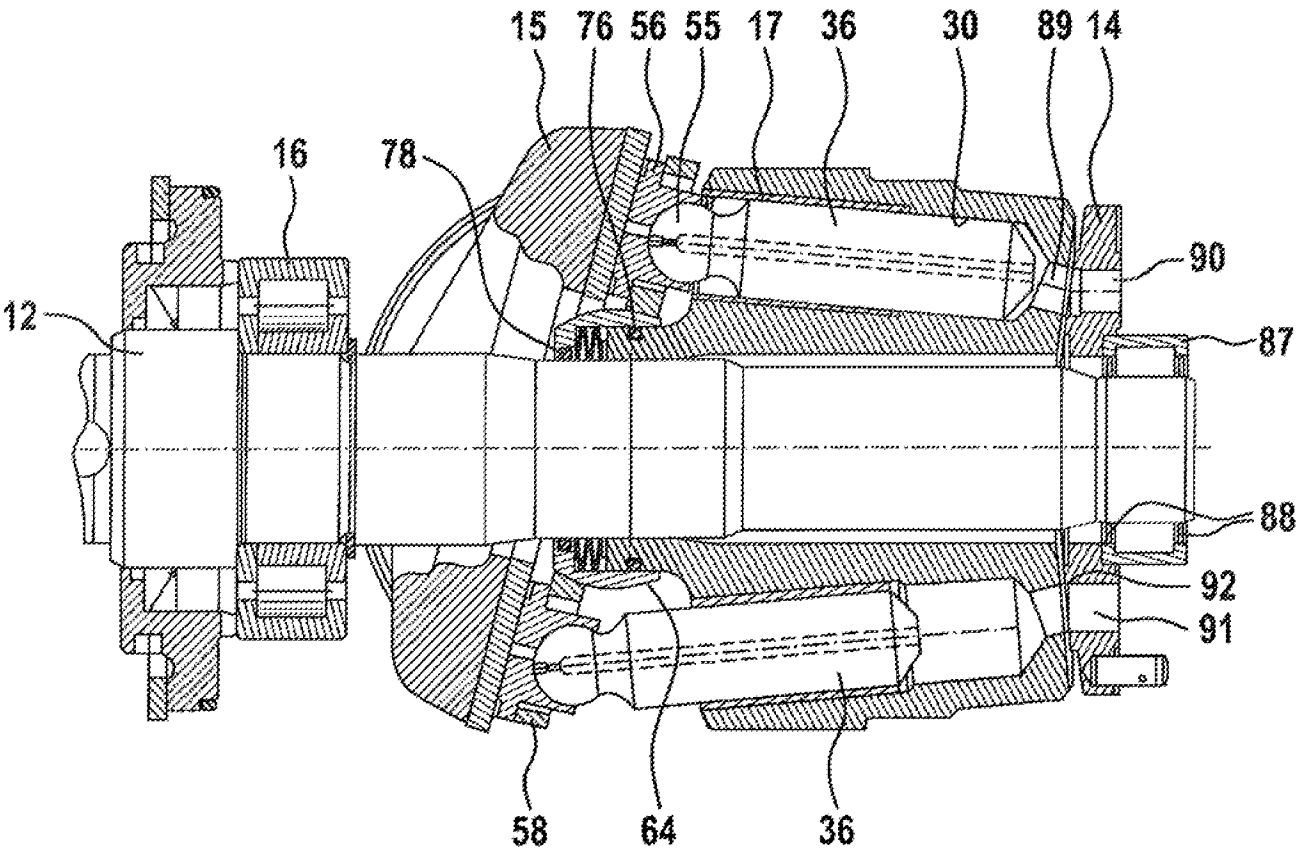
FIG. 3 shows a longitudinal section through the drive mechanism of the second exemplary embodiment which is a hydrostatic axial piston pump that can be adjusted in terms of its stroke volume with a control plate with two control kidneys.

The drive mechanism of the second exemplary embodiment shown in FIG. 3, as in the case of the drive mechanism of the first exemplary embodiment, has a drive shaft 12, a cylinder drum 13, a control plate 14 and also a pivot cradle 15 which is adjustable in terms of its inclination relative to the axis of the drive shaft. The design is similar to that of the first exemplary embodiment. In the following, therefore, attention will be focused primarily on the differences.

The drive shaft 12 is mounted rotatably via a rolling contact bearing 16 and a rolling contact bearing 87 which occurs at the position of the bearing bush 17 from FIG. 1. As with the bearing bush 17, the rolling contact bearing 87 should also have a sealing function. It is therefore configured as a bearing with two sealing rings 88.

The drive mechanism shown in FIG. 3 is for a standard displacement pump. A plurality of cylinder bores 30 lying on the same pitch circle evenly distributed over the circumference, for example eight or nine cylinder bores, is introduced into the main body 21, said cylinder bores being placed slightly obliquely in respect of the center axis 25. The cylinder bores 30 are open via passages 89 to the inner end face 41 of the cylinder drum 13 facing the control plate 14, wherein the cross section of the passages 89 in a plane standing perpendicularly on the center axis 25 is smaller than the cross section of the cylinder bores 30 in a plane of this kind. In this way, an axially directed force is produced by the pressure in the cylinder bores 30 from which pressure medium is being displaced, which force presses the cylinder drum 13 against the control plate 14 and the engagement point thereof is spaced apart from the center axis 25.

Precisely two control grooves 90 and 91 are formed in the control plate 14 which extend in arcuate fashion over an angle smaller than 180° and between which there are two reversing regions. The control grooves are sealed on the side of the control plate 14 facing the cylinder drum 13 in relation to a central passage of the control plate by a sealing web 92. On the side of the control plate 14 facing away from the cylinder drum 13 the control grooves are open, in other words they pass through the control plate, and are fluidically connected via fluid channels in a connection plate which is not shown to two outside connections of the displacement pump. A control groove may be composed of a plurality of individual openings. If the displacement pump is designed for use in an open hydraulic circuit, one of the control grooves is the high-pressure groove and the other control groove is the low-pressure groove, wherein the fluid channel between the low-pressure groove and the corresponding working connection 50 and this working connection is configured with larger cross sections than the other fluid channel and the other working channel. If the displacement pump is designed for use in a closed hydraulic circuit, the two control grooves can be the high-pressure groove and the low-pressure groove alternately. When the cylinder drum 13 turns, the passages 89 pass over the control openings 90 and 91 and are connected to the one and the other working connection one after the other during a rotation. Between the sealing webs enclosing the high-pressure groove and the cylinder drum 13, pressure fields are formed which counteract the contact pressure. Additional so-called pressure relief fields may also be configured on the control plate 14, through which the cylinder drum 13 is prevented from pressing too forcefully on the control plate 14.

It should be pointed out that in the depiction according to FIG. 3 the rotational position of the cylinder drum 13 relative to the control plate 14 is not true to life. According to FIG. 3, a displacement piston 36 is located at its inner dead point in which it is introduced furthest into its cylinder bore 30 and a displacement piston 36 is located at its outer dead point in which it projects furthest from its cylinder bore 30. Therefore, in the rotational position of the cylinder drum shown, the two visible passages 89 pass over the reverse regions on the control plate 14, which means that if the control plate 14 were in the same plane as the cylinder drum 13, the control grooves 90 and 91 would not be visible. So that the interaction of the passages 89 and the control grooves 90 and 91 can be identified more clearly, the manner of representation according to FIG. 3 is chosen.

With a drive mechanism of the kind depicted in FIG. 3 for a displacement pump that can be adjusted in terms of its stroke volume, the cylinder drum can be briefly lifted from the control plate 14 depending on the application, because the relief force exceeds the contact pressure or a tipping moment becomes too great. A large quantity of pressure medium is then suddenly forced into the interior between the drive shaft 12 and the cylinder drum, as a result of which the pressure rises sharply there due to the throttle action of the two sets of toothing 28 and 29 meshing with one another on the cylinder drum and on the drive shaft. This pressure produces an additional force in the relief direction, so that lifting is reinforced and it is possible for the drive mechanism to be destroyed.

According to the disclosure, in the case of the drive mechanism according to FIG. 3 the free space 68 between the cylinder drum 13, the drive shaft 12 and the retraction ball 64 is sealed and forms a retraction ball pressure chamber. A first sealing ring 76 lies in an annular groove 75 formed on the outside of the drum neck 27 and creates a seal between the retraction ball 64 and the cylinder drum 13. A second sealing ring 78 lies in an annular groove 77 formed on the inside of the inner collar 66 of the retraction ball 64 and creates a seal between the retraction ball and the drive shaft 12. If there is lifting of the cylinder drum 13 from the control plate 14, the pressure therefore rises not only in the central cavity 26, but also in the annular retraction ball pressure chamber 68, so that a force is generated on the axial annular surface 70 of the drum neck which tries to press the cylinder drum onto the control plate 14. This force is even greater in the present case than the force produced by the pressure in the cavity 26 and acting in the lifting direction, since the sealing diameter between the drum neck 27 and the retraction ball 64 is greater than the inner diameter of the sealing web 92.

Consequently, through a lifting of the cylinder drum 13 from the control plate 14, a resulting additional force is generated in the pressing direction which counteracts the lifting. In this way, the drive mechanism is effectively protected from destruction.

LIST OF REFERENCE NUMBERS

10 Pot-like housing
11 Connection plate
12 Drive shaft
13 Cylinder drum
14 Control plate
15 Pivot cradle
16 Rolling contact bearing
17 Bearing bush
24 Main body of 13
25 Center axis 24
26 Central cavity in 24
27 Drum neck
28 Toothing on 24
29 Toothing on 12
30 Cylinder bore
31 Outer end face of 13
32 Bushing in 30
36 Displacement piston
40 Sliding layer on 13
41 Inner end face of 13
42 Control surface of 14
43 Control groove in 14
44 Control groove in 14
45 Control groove in 14
46 Control groove in 14
47 Radial bore in 13
48 Locking screw
49 Axial bore
50 Working connection in 11
55 Spherical head of 36
56 Sliding shoe
57 Adjusting device
58 Retraction plate
59 Break-throughs in 58
60 Central opening in 58

61 Edge of 60
64 Retraction ball
65 Ball zone on 64
66 Inner collar on 65
67 Axial portion on 65
68 Annular free space, retraction ball pressure chamber
69 Plate spring
70 Annular surface on 27
75 Annular groove in 27
76 Sealing ring in 75
77 Annular groove in 12
78 Sealing ring in 77
80 Space in 11
81 Bore in 11
82 Bore in 11
83 External pressure connection
87 Rolling contact bearing
88 Sealing rings on 87
89 Passage
90 Control groove in 14
91 Control groove in 14
92 Sealing web

What is claimed is:

1. A swashplate-type hydrostatic axial piston machine, comprising:

a housing;

a connection plate that closes the housing;

a plurality of working connections formed on the connection plate;

a drive shaft rotatably mounted in the housing and in the connection plate;

a swashplate;

a cylinder drum coupled to the drive shaft and including a first end face, a second end face, and a drum neck;

a plurality of cylinder bores defined in the cylinder drum;

a plurality of displacement pistons, each of which is located in an associated one of the plurality of cylinder bores and is movable back and forth in the associated cylinder bore, each displacement piston projecting on the first end face from the cylinder drum and resting against the swashplate;

a control plate against which the second end face bears;

a retraction plate configured to remove each displacement piston from the plurality of cylinder bores on one half of a rotation;

a retraction ball arranged at the first end face surrounding the drum neck and the drive shaft, the retraction plate loaded in a direction of the swashplate via the retraction ball; and a retraction ball pressure chamber formed with a first seal between the retraction ball and the cylinder drum, a second seal between the retraction ball and the drive shaft, and a third seal between the shaft and the connection plate.

2. The hydrostatic axial piston machine according to claim 1, wherein a sealing diameter of the first seal is greater than an inner diameter of a sealing surface between the cylinder drum and the control plate.

3. The hydrostatic axial piston machine according to claim 1, wherein the retraction ball pressure chamber is connected to an external pressure connection via a fluid path.

4. The hydrostatic axial piston machine according to claim 3, wherein the external pressure connection is located on the connection plate and the fluid path leads from the external pressure connection through the connection plate into the retraction ball pressure chamber.

5. The hydrostatic axial piston machine according to claim 1, wherein:

the hydrostatic axial piston machine includes a high-pressure side and a low-pressure side; and the retraction ball pressure chamber is connected to the high-pressure side via a fluid path.

6. The hydrostatic axial piston machine according to claim 2, wherein the first seal includes a sealing ring inserted into an annular groove defined on the drum neck and bearing against the retraction ball.

7. The hydrostatic axial piston machine according to claim 1, wherein:

the second seal includes a sealing ring inserted into an annular groove defined on the drive shaft; and the sealing ring bears against the retraction ball.

8. The hydrostatic axial piston machine according to claim 1, wherein:

the drive shaft is rotatably mounted in the connection plate on a side of the control plate opposite the cylinder drum via a bearing; and the bearing is configured as the third seal.

9. The hydrostatic axial piston machine according to claim 8, wherein:

the drive shaft includes a shaft end face positioned within the connection plate; and leakage flowing into a space between the shaft end face and the connection plate is diverted by a fluid path.

10. The hydrostatic axial piston machine according to claim 8, wherein the bearing is a slide bearing configured as a bearing bush.

11. The hydrostatic axial piston machine according to claim 10, wherein:

the bearing includes a pair of sliding surfaces which are between the bearing bush and the drive shaft; and neither of the pair of sliding surfaces includes a groove.

12. The hydrostatic axial piston machine according to claim 1, wherein the hydrostatic axial piston machine is a vibration drive hydrostatic axial piston machine, further comprising:

a plurality of grooves arranged concentrically to one another in the control plate, wherein each groove of the plurality of grooves is permanently fluidically connected to a cylinder bore of the plurality of cylinder bores and to a working connection of the plurality of working connections.

13. The hydrostatic axial piston machine according to claim 1, therefore the hydrostatic axial piston machine is a hydrostatic axial piston pump.

* * * * *